US006078644A

United States Patent [19]

Day et al.

[11] Patent Number: 6,078,644

[45] Date of Patent: Jun. 20, 2000

[54] CARBON-BACKED X-RAY TARGET WITH COATING

[75] Inventors: Mary E. Day; Michelangelo Delfino, both of Los Altos, Calif.

[73] Assignee: Varian Medical Systems, Inc., Palo Alto, Calif.

[21] Appl. No.: 09/108,574

[22] Filed: Jul. 1, 1998

[51] Int. Cl.[7] ..... H01J 35/10

[52] U.S. Cl. ..... 378/144; 378/143

[58] Field of Search ..... 378/144, 143

[56] References Cited

U.S. PATENT DOCUMENTS

| | | | |
|---|---|---|---|
| 3,969,131 | 7/1976 | Fatzer et al. | 428/316 |
| 4,516,255 | 5/1985 | Petter et al. | 378/143 |
| 4,597,095 | 6/1986 | Akpan | 378/144 |
| 4,641,334 | 2/1987 | Devine, Jr. | 378/144 |
| 4,689,810 | 8/1987 | Devine, Jr. | 378/144 |
| 4,700,882 | 10/1987 | Devine, Jr. | 228/194 |
| 4,736,400 | 4/1988 | Koller et al. | 378/125 |
| 4,777,643 | 10/1988 | Devine, Jr. | 378/144 |
| 4,802,196 | 1/1989 | Tiearney, Jr. et al. | 378/143 |
| 4,901,338 | 2/1990 | Rödhammer et al. | 378/144 |
| 4,975,621 | 12/1990 | Fukubayashi et al. | 313/633 |
| 4,978,051 | 12/1990 | Tiearney, Jr. et al. | 228/124.5 |
| 5,008,918 | 4/1991 | Lee et al. | 378/144 |
| 5,148,463 | 9/1992 | Woodruff et al. | 378/144 |
| 5,204,891 | 4/1993 | Woodruff et al. | 378/143 |

OTHER PUBLICATIONS

Article by Mumtaz et al., entitled "Thermal cycling of iridium coatings on isotropic graphite", published in *Journal of Materials Science* in 1995, in vol. 30, pp. 465–472.

Article by Criscione et al., entitled "Protection of Graphite from Oxidation at 2100° C", published in *AIAA Journal* in Oct. 1966, in vol. 4, No. 10, pp. 1791–1797.

Article by Clift et al., entitled "Deposition and analysis of Ir–Al coatings for oxidation protection of carbon materials at high temperatures", published in *Surface and Coatings Technology* in 1990, in vol. 42, pp. 29–40.

*Primary Examiner*—David V. Bruce
*Assistant Examiner*—Allen C. Ho
*Attorney, Agent, or Firm*—Bradford L. Friedman; Bella Fishman

[57] ABSTRACT

An x-ray target has a substrate of a carbonaceous material such as graphite which is secured to a rotary shaft so as to rotate therewith. A portion of outer peripheral surface of the substrate is covered by a target plate, while the other portion is covered with a thin iridium layer with thickness in a range between 50 Å and 250 Å so that the trapped gas species like $H_2$, CO, $CO_2$ can escape therethrough, and to retard the diffusion of ambient gas species into the substrate while the infrared emissivity of the underlying substrate is not lowered appreciably thereby.

10 Claims, 1 Drawing Sheet

CARBON-BACKED X-RAY TARGET WITH COATING

FIELD OF THE INVENTION

This invention relates to a carbon-backed x-ray tube target such as a rotary metal-graphite composite target and more particularly to an x-ray target with a graphite substrate coated with a layer of chemically inert refractory metal.

BACKGROUND OF THE INVENTION

Rotary metal-graphite composite targets for x-ray tubes have been known and described, or example, in the U.S. Pat. No. 4,901,338, as targets having an annular graphite substrate secured to the back surface of a disk-shaped target made of a refractory metal material such as tungsten, molybdenum or related alloys such as titanium—zirconium—molybdenum (TZM). Graphite has been considered a suitable material for the manufacture of rotary anodes for x-ray tubes because graphite is resistant to acid, chemically inert and has a significantly higher heat capacity and thermal emissivity than metals. However, when used as a part of a rotary x-ray tube target, the substrate graphite has temperature about 1100° C. under normal operating conditions and therefor is sensitive to its environment. Although the target is usually maintained in a vacuum environment, there are problems which are associated with the x-ray tube operation.

There is the problem with oxidation process which degrades the graphite, producing carbon monoxide and/or carbon dioxide even at relatively low temperatures below 400° C. The hydration process can cause a degradation of the graphite substrate, forming a series of hydrocarbons, at relatively high temperatures above 800° C. These gases, as well as the high pressures generated in the x-ray tube, have adverse effects on the useful lifetime of a tungsten filament.

It has been known in the art to protect carbonaceous materials such as graphite and carbon—carbon composites at high temperatures against oxidation by applying different coatings. Mumtaz, et al. disclosed iridium coatings on isotropic graphite (Journal of Material Science, 30, 1995, 465). Criscione, et al. disclosed iridium coatings on graphite (AIAA Journal, 4, 1996, 1791). Clift, et al. disclosed the use of Ir—Al coatings (Surface and Coatings Technology, 42, 1990, 29). However, these thick coatings for protection of carbonaceous materials created serious problems and could not be successfully utilized for manufacturing the carbon-baked x-ray tube targets. They tend to have stresses that can result in poor adhesion to the substrate, have large grains that do not provide good diffusion barrier properties, and adversely affect the emissivity of graphite substrates when optically opaque.

SUMMARY OF THE INVENTION

It is therefore an object of this invention to provide a carbon-backed x-ray tube target which is well protected against the environmental gases and yet has sufficient infrared emissivity.

A carbon-backed x-ray tube target embodying this invention, with which the above and other objects can be accomplished, comprising a graphite substrate and a target member made of a refractory material secured to the front surface of the substrate, wherein the surface of the graphite substrate not covered by the target member is provided with a thin layer of chemically inert refractory metal. According to the preferred embodiment of the present invention a thin iridium coating of thickness less than 250 Å and preferably between 150 Å and 200 Å is deposited to the graphite substrate. A layer of iridium with thickness within this range is sufficiently thick to retard the diffusion of ambient gas species such as hydrogen, water, carbon monoxide and oxygen into the substrate, while it is sufficiently thin to permit the escape of trapped gases such as hydrogen, carbon monoxide and carbon dioxide which may be desorbed from the substrate. Moreover, the iridium layer is optically thin so that the infrared emissivity of the underlying substrate is not appreciably lowered, or that the accompanying antireflective effect is minimized. According to the preferred embodiment of the invention, the surface of the graphite substrate is roughened prior to the deposition of the iridium layer thereon for increasing the surface emissivity.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
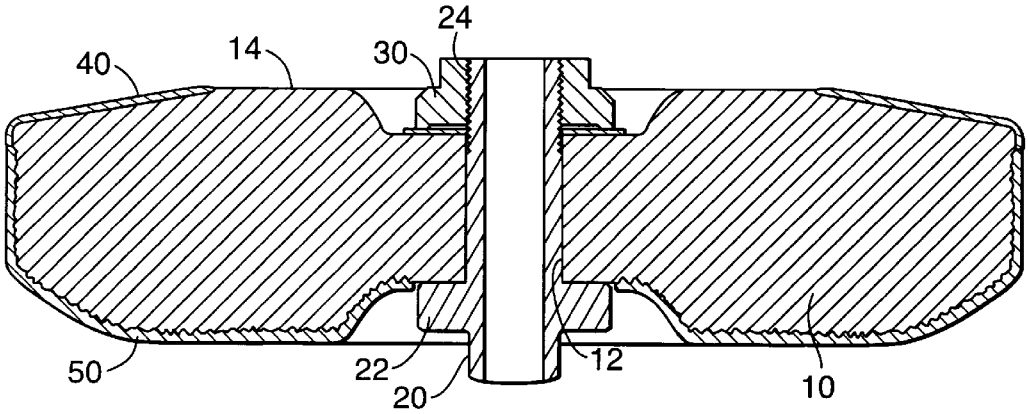
FIG. 1 is a schematic sectional view of a portion of a rotary x-ray tube target embodying the present invention.

FIG. 1 shows a portion of a carbon-backed x-ray tube target embodying the present invention. It should be noted that FIG. 1 is intended to be merely schematic and not to realistically represent dimensional relationships of various parts of the target. A generally disk-shaped graphite substrate 10 has central opening 12 penetrated by shaft 20. Shaft 20 is connected to drive motor (not shown) so as to be rotatable around its longitudinal axis. Graphite substrate 10 and shaft 20 are secured to each other such that they can rotate together. The connection between shaft 20 and graphite substrate 10 may be accomplished, for example, by brazing or, as shown in FIG. 1, by causing one side of graphite substrate 10 to rest against an outwardly protruding flange portion 22 of shaft 20. Graphite substrate 10 is tightening from its opposite side by nut 30 which engages with threaded portion 24 of the outer surface of shaft 20. Substrate 10 can be fastened to shaft 20 in any other conventional manner.

One of the main surfaces of graphite substrate 10, herein referred to as "front surface 14" has a conical peripheral region over which is secured an annular target plate 40 of a refractory metallic material (tungsten, molybdenum and their alloys including TZM) for generating x-rays by being bombard by a beam of electrons. As shown in FIG. 1, target plate 40 covers a portion of the side surface of graphite substrate 10.

Layer 50 of chemically inert refractory metal is deposited over at least a portion of, and preferably nearly all over portions of the surfaces of graphite substrate 10 which is not covered by target plate 40. The material of layer 50 should be sufficiently thick to retard the diffusion of ambient gas species such as hydrogen, water, carbon monoxide, and oxygen into graphite substrate 10. In the preferred embodiment of the present invention layer 50 is made of iridium and having a thickness between 50 Å and 250 Å, and more preferably between 150 Å and 200 Å. The deposition of the iridium layer may be carried out in an electron beam evaporation system, however, the method of deposition does not limit the scope of the invention. For example, it may be sputtered or chemically vapor deposited using a suitable source.

Shielding of a graphite substrate with an iridium layer for the x-ray tube target application have been studied by test experiments. Graphite backed x-ray targets with 99.9% purity with respect to metal basis were outgassed in a vacuum environment by heating with an infrared lamp mounted inside a vacuum chamber until Residual Gas Analysis traces showed that characteristic hydrocarbon peaks were no longer present. After they were cooled to room temperature, electron-beam evaporated iridium was deposited onto each of the rotating target assemblies under vacuum base pressure of less than $1\times10^{-6}$ torr by physically masking off the shaft and the area for the target plate. The target assembly was rotated so as to obtain a uniform layer or film thickness. The deposition rate was controlled by adjusting the 10 kW electron beam. Film thickness was specified with a quartz crystal monitor on the assumption of a density of iridium (22.4 $g/cm^3$) and a value for the acoustical impedance ($8.83\times10^5$ $g/cm^2$).

Figure 2:
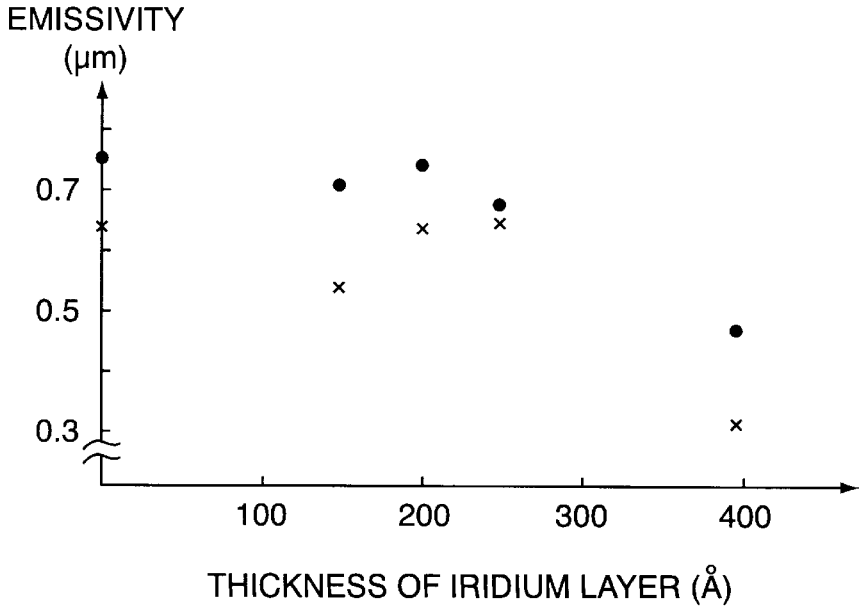
FIG. 2 shows the experimental results of relationship between emissivity of the graphite substrate and thickness of iridium layer at room temperature.

Test samples with different film thicknesses were produced on graphite sheets. FIG. 2 shows the measured emissivities of graphite sheets at room temperature obtained by taking an FT-IR reflectance spectrum at normal incidence by using a gold mirror as a reference. The results are shown by assuming zero transmittance. In FIG. 2, black circles show emissivities at 10 mm and crosses show emissivities at 5 mm. The zero thickness indicates that samples are not coated with any iridium film.

The obtained results of FIG. 2 demonstrates that thin iridium films have almost no effect on the emissivity until they become optically opaque as their thickness becomes greater than 250 Å. Moreover, near-normal, wide-band (8–14 mm) measurements made on coated samples, when normally cycled in air from 80 to 300° C. confirm their optical stability; i.e., no practical changes in value of emissivity.

The resistance against oxidation and corrosion was tested in a flowing dry $O_2/HCl/N_2$ (1:5:2) ambient at 380° C. for one hour. This condition was sufficient to completely vaporize an uncoated graphite piece into carbon dioxide, causing it to disappear. In comparison, even the samples coated with the iridium film of thickness 150 Å did not degrade when cycled in the same ambient in succession at 380° C. for one hour; at 500° C. for one hour, and then at 600° C. for one hour. The barrier properties of thin iridium films with respect to oxidation have thus been clearly demonstrated.

According to a preferred embodiment of the invention, the portions of the surface of the substrate which are exposed and are intended to be covered by an iridium film are roughened, as shown in FIG. 1 in a somewhat exaggerated manner, for increasing emissivity. The roughening of a smooth and/or wavy surface of the graphite substrate is provided by creating irregularities having their heights substantially greater than their periodicity. The roughened surface may be obtained by utilizing physical processes (grinding wheel or bead blasting), and/or chemical processes (thermal or plasma oxidations).

The present invention provides a chemically resistant, hardened, semi-permeable coating of a material having a characteristically small crystalline grain size or preferably being in an amorphous phase. Unlike prior art examples of iridium coating of a carbonaceous material, iridium films according to the present invention are optically thin enough to permit escape of trapped gases ($H_2$, CO and $CO_2$) and do not lower the infrared emissivity of the underlying substrate. This coating does not delaminate when stressed repeated, as would occur when it is thermally cycled and that the iridium coating increases the hardness of the target as a whole and the generation of particles which create instability of x-ray tubes can be reduced.

In view of the advantages which can be achieved by the present invention, rhodium with melting point 1966° C. or ruthenium with melting point about 2310° C. may be used instead of iridium with melting point 2450° C. in the above disclosure. These elements adhere well to carbonaceous materials and are thermally stable with respect to carbide formation.

Although the invention was described above with reference to certain examples, the examples are not intended to limit the scope of the invention. Many modifications and variations are possible within the scope. For example, the manners in which the graphite substrate is secured to the rotary shaft and to the metallic target plate are not intended to limit the scope of the invention. The invention is applicable not only to graphite substrates but also to substrates comprising all kinds of carbonaceous material such as carbon—carbon composites.

What is claimed is:

1. A carbon-backed x-ray target comprising:

a rotary shaft;

a substrate of a carbonaceous material having an outer peripheral surface, said substrate being connected to said rotary shaft for rotation therewith;

a target plate secured to said outer peripheral surface of said substrate; and a layer of chemically inert refractory metal shielding at least a portion of said outer peripheral surface of said substrate outward said target plate, said layer having thickness which is in a range between 50 Å and 250 Å and is sufficient to retard the diffusion of ambient gas species while maintaining an infrared emissivity of said substrate.

2. The carbon-backed x-ray target of claim 1, wherein said layer is made of ruthenium.

3. The carbon-backed x-ray target of claim 1, wherein said layer is made of rhodium.

4. The carbon-backed x-ray target of claim 1, wherein said layer is made of iridium.

5. The carbon-backed x-ray target of claim 4, wherein said iridium layer has thickness in a range between 150 Å and 200 Å.

6. The carbon-backed x-ray target of claim 5, wherein said outer peripheral surface of substrate has a roughened region.

7. The carbon-backed x-ray target of claim 6, wherein said iridium layer covers at least a portion of said roughened region.

8. A carbon-backed x-ray target comprising:

a rotary shaft;

a substrate of a carbon—carbon composite material having an outer peripheral surface, said substrate being connected to said rotary shaft for rotation therewith; and a layer of iridium covering at least a portion of said outer peripheral surface of said substrate outward said target plate, said layer being optically thin and having thickness which is in a range between 150 Å and 250 Å wherein the numerical value of infrared emissivity of said substrate is substantially unaffected by said layer.

9. The carbon-backed x-ray target of claim 8, wherein said layer of iridium has thickness of about 200 Å.

10. The carbon-backed x-ray target of claim 9, wherein said substrate has a roughened region, said roughened region at least partially is covered by said layer of iridium.

* * * * *